US009642414B2

(12) United States Patent
Lindsay et al.

(10) Patent No.: US 9,642,414 B2
(45) Date of Patent: May 9, 2017

(54) FOOTWEAR

(75) Inventors: Leslie Lindsay, Brackley (GB); Rolf Lewis Thomas, Worthing (GB)

(73) Assignee: THE DIABETIC BOOT COMPANY LIMITED, Aylesbury, Bucks (GB)

( * ) Notice: Subject to any disclaimer, the term of this patent is extended or adjusted under 35 U.S.C. 154(b) by 531 days.

(21) Appl. No.: 13/985,754

(22) PCT Filed: Feb. 15, 2012

(86) PCT No.: PCT/GB2012/000156
§ 371 (c)(1),
(2), (4) Date: Aug. 15, 2013

(87) PCT Pub. No.: WO2012/110763
PCT Pub. Date: Aug. 23, 2012

(65) Prior Publication Data

US 2013/0326912 A1 Dec. 12, 2013

(30) Foreign Application Priority Data

Feb. 15, 2011 (GB) ..... 1102637.4
Mar. 16, 2011 (GB) ..... 1104459.1

(51) Int. Cl.
*A43B 3/00* (2006.01)
*A43B 7/14* (2006.01)
*A43B 13/20* (2006.01)

(52) U.S. Cl.
CPC ..... *A43B 3/00* (2013.01); *A43B 3/0005* (2013.01); *A43B 7/146* (2013.01); *A43B 13/203* (2013.01)

(58) Field of Classification Search
CPC ..... A43B 3/00; A43B 3/0005; A43B 7/146; A43B 13/186; A43B 13/203;
(Continued)

(56) References Cited

U.S. PATENT DOCUMENTS 4,502,470 A 3/1985 Kiser et al.
4,624,244 A 11/1986 Taheri
(Continued)

FOREIGN PATENT DOCUMENTS

GB 2454089 4/2009
WO 0021471 4/2000
(Continued)

OTHER PUBLICATIONS

Armstrong et al., "Improvemnet in Healing With Aggressive Edema Reduction After Debridement of Foot Infection in Person with Diabetes", Arch Surg, vol. 135:1405-1409 (Apr. 17, 2010).
(Continued)

*Primary Examiner* — Quang D Thanh
(74) *Attorney, Agent, or Firm* — Christensen Fonder Dardi; Curtis Herbert

(57) ABSTRACT

The present invention relates to footwear and in particular, but not necessarily restricted thereto, relates to footwear for those with diabetes and, in particular, with ulcers of the sole. The present invention seeks to address some of the problems encountered by prior art limb compression devices and methods. In particular the present invention seeks to provide a boot which can stimulate blood flow. A further object to the invention is to provide a boot with a sole which is adaptable to conform with various shapes and conditions of human feet. The present invention also seeks to provide a new type of footwear that has a therapeutic benefit for diabetic patients with circulatory problems in their foot, and also enables the technique of "off loading" the foot to assist in the healing of any wounds present. The present invention relates to a method for aiding arterial and venous flow from the limb of an ambulatory patient comprising the step of applying pressure to one or more areas of the soft tissue of an underside portion of the foot.

18 Claims, 5 Drawing Sheets

(58) Field of Classification Search
CPC ..... A43B 13/206; A61H 9/00; A61H 9/0078; A61H 2205/12
See application file for complete search history.

(56) References Cited

U.S. PATENT DOCUMENTS

| | | | | |
|---|---|---|---|---|
| 4,809,684 | A | 3/1989 | Gardner et al. | |
| 5,218,954 | A | 6/1993 | Van Bemmelen | |
| 5,353,525 | A * | 10/1994 | Grim | A43B 7/081 36/114 |
| 5,545,129 | A | 8/1996 | Snook | |
| 6,430,843 | B1 * | 8/2002 | Potter | A43B 3/0005 36/28 |
| 6,589,194 | B1 * | 7/2003 | Calderon | A43B 7/00 601/151 |
| 2010/0324455 | A1 * | 12/2010 | Rangel | A43B 7/147 600/592 |
| 2011/0131839 | A1 * | 6/2011 | Ballin | A43B 13/186 36/141 |

FOREIGN PATENT DOCUMENTS

| | | |
|---|---|---|
| WO | 2008051165 | 5/2008 |
| WO | 2011067768 | 6/2011 |

OTHER PUBLICATIONS

International Search Report from corresponding PCT Application No. PCT/US2012/000156, 3 pages, Dated Jun. 15, 2012.
International Search Report from corresponding PCT Application No. PCT/GB2012/000156, 3 pages, Dated Jun. 15, 2012.
PulseFlow Technologies, Diabetic Foot Ulcer Treatment, Wearable Technology for the Treatment of Diabetic Foot Ulcers, http://www.pulse-flow.net, 1 page, printed from website on Jul. 20, 2016.
XP Diabetic Walker System, DJO Global, http://www.djoglobal.com/products/aircast/xp-diabetic-walker-system, 3 pages, printed from website on Jul. 20, 2016.
Cavanagh et al., "Off-Loading the Diabetic Foot for Ulcer Prevention and Healing", Journal of Vascular Surgery, 52(12S):37S-43S (2010).
Ennis et al., "Standard, Appropriate, and Advanced Care and Medical-Legal Considerations: Part One—Diabetic Foot Ulcerations (A)",Wounds, 15,(4):92-106 (Apr. 2003).

* cited by examiner

FOOTWEAR

CROSS REFERENCE TO RELATED APPLICATIONS

This application is a national stage filing of PCT application number PCT/GB2012/000156 filed on Feb. 15, 2012, which claims priority to United Kingdom patent application numbers 1102637.4 filed on Feb. 15, 2011, and 1104459.1 filed on Mar. 16, 2011, all of which are incorporated herein by reference.

FIELD OF THE INVENTION

The present invention relates to footwear and in particular, but not necessarily restricted thereto, relates to footwear for those with diabetes and, in particular, with ulcers of the sole. The present invention also relates to a method for aiding cardiocepital venous flow from the foot and leg of an ambulatory patient who is suffering from diseased foot and leg veins which results in venous hypertension.

BACKGROUND OF THE INVENTION

Improvement of arterial blood flow, in patients with obstruction of the arteries to the leg, is usually obtained by surgically bypassing the occluded arteries, or by removing obstructions with devices that are inserted into the blood vessel. In elderly patients who have undergone multiple vascular procedures, the deterioration of arterial blood flow can lead to severe pain (ischaemic neuritis), tissue loss (arterial ulcers) or toe loss (gangrene). When the arteries of the leg cannot be repaired anymore, this situation may lead to leg amputation. Blood flow in patient's extremities, particularly the legs, markedly decreases during extended terms of confinement. Such pooling or stasis is particularly acute in surgery and during recovery periods immediately thereafter.

Diabetes is a disease where the body isn't making any or a sufficient amount of insulin and is increasingly affecting the senior and for obese members of society. Poor venous return is a symptom of this disease and affects, in particular, the lower legs and feet. Diabetes is a disease commonly associated with neuropathy.

Charcot foot is a condition causing weakening of the bones in the foot that can occur in people who have significant nerve damage (neuropathy), whereby the ability to feel temperature, pain, or trauma is diminished. Because of the diminished sensation, the patient may continue to walk-making the injury worse. Similarly to diabetic patients, those with Charcot foot should take timely action upon diagnosis otherwise the disease can ultimately lead to the loss of a toe, foot, leg or life.

There are surgical and non-surgical treatments for Charcot foot, but it will be appreciated that non-surgical treatment is preferred. Such non-surgical treatment and include immobilization—since the foot and ankle are so fragile during the early stage of Charcot, they must be protected so the weakened bones can repair themselves. Complete non-weight-bearing (off-loading) is necessary to keep the foot from further collapsing. Typically, the bones are weakened enough to fracture, and with continued walking the foot eventually changes shape. As the disorder progresses, the joints collapse and the foot takes on an abnormal shape, such as a rocker-bottom appearance.

In the past, numerous devices and methods have been disclosed for aiding cardiocepital venous flow to prevent venous hypertension. These devices and methods usually included the use of boots placed around the foot and leg and pressure was applied to the foot and leg—which are extremely cumbersome. Sufferers effectively become immobile. In addition, the prior devices did not concentrate the pressure in those areas in which it was most effective, namely, the soft tissue areas of the foot and leg, and therefore they did not operate efficiently. Further, ambulatory solutions have not been provided; there has been a need to be connected with mains supply powered stationary equipment.

Certain treatments comprise of a massager composed of a linear compressor having a piston reciprocated by force of electromagnetic attraction to produce compressed air at a safe pressure with a relatively small difference between the rated pressure and the maximum pressure, a distributor for allowing the compressed air fed from the compressor to be selectively discharged therefrom and a bag having a plurality of air tight sections which are successively expanded by receiving the compressed air fed from the distributor.

Other devices have comprised pressure-fluid massage machines and devices which have been provided with a bag means of rubber or the like, which is wound around a portion to be treated on the subject and expanded by supplying thereto a pressure fluid such as compressed air to exert massaging pressure upon the portion to be treated, thereby massaging the subject.

A patient may be fitted with a cast, removable boot, or brace, and may be required to use crutches or a wheelchair. Once fitted with a cast, blood flow will be reduced, leading to an increased likelihood of ulcers, further hampering remedial treatment of the underlying condition, bearing in mind that the condition arises through neuropathy. It may take the bones several months to heal, although it can take considerably longer in some patients. Shoes with special inserts are typically utilised after the bones have healed to enable a patient to return to daily activities, as well as seeking to prevent recurrence of the condition or associated conditions such as the development of ulcers.

The Aircast Corporation produce a diabetic walker device comprising a special form of boot which incorporates an off-loading boot a high rocker sole for maximum off-loading of the diabetic foot and a dual density insole to help eliminate pressure points. This insole, when combined with the semi-rigid shell and full air-cell coverage, also helps regulate shear stress. This design also maximises plantar offloading and is said to provide both protection and immobilisation.

U.S. Pat. No. 5,218,954 teaches of a device which operates by providing simultaneous and rapid compression of the soft tissues of the calf, ankle and foot, thereby completely and instantly emptying the veins, and reducing venous pressure to zero in a sitting patient position. Upon rapid deflation of the boot, the reduced venous pressure results in an increased driving pressure for the arterial blood flow. The increased arterial blood flow will occur approximately one second after deflation, and will last for approximately 4-14 seconds. The compression phase itself does not improve arterial flow, but impedes arterial flow; therefore compression is kept as short as possible. A stiff, non-elastic outer case for the lower leg and foot reduces the amount of fluid (air) needed to inflate the relatively small bladder. The shape of the bladder provides a contiguous connection between the foot part and the calf part, the bladder overlying the area between ankle bone and heel bone results in effective compression of the soft tissues in front of the Achilles tendon, which contain the veins draining the foot.

U.S. Pat. No. 4,502,470 provides a physiologic device having a fluid filled compartment. This is surrounded by an outer sheath fastened to the foot. The sheath holds the compartment under the instep and directs the hydraulic forces into the ankle and lower leg. Pressure produced by walking on the fluid compartment is used to compress the lower leg. This prevents swelling and it can heal ulcers due to bad veins. U.S. Pat. No. 4,624,244 teaches of a cuff for an ambulatory patient, wherein the cuff is placed around the lower calf and foot of a person suffering from circulatory problems. Air bladders are pulsated about the lower calf and soft tissue of the foot by means of a pump and pulse-inducing flow control means. The cuff does not provide a shoe as such and various fasteners are secured so that the cuffs 11 and 13 fit snugly, but not so tight as to impair circulation of a foot.

U.S. Pat. No. 4,809,684 teaches of a device and method for venous-flow stimulation, through localized periodic application of squeezing forces, essentially limited to the phalanx of the digits and thumb, and to the adjacent region of the palm of the hand. To this end, an inflatable mitt is applied to the said phalanx and adjacent regions, with digits and thumb projecting beyond the mitt. The squeeze is applied in unison circumferentially around each of the individual digits (and thumb) at the phalanx region. Alternatively, the inflatable mitt may be embedded in an orthopaedic cast, without impairing the application of pulsed pressure local to the indicated region in this case the circumferential tie is provided by the case. The arterial throughput is enhanced when the stimulating pulse is sustained for a brief period prior to a relaxation dwell between pulses. However, this system does, nonetheless need a power supply and cannot provide an integrated system.

WO0021471 (P Vinci) teaches of an in-shoe device for footdrop and is used with regular or custom-made shoes, high up to the ankle, has the purpose to correct the "steppage" coming from the deficit of foot—dorsiflexion which occurs with Charcot foot. The device has a back support in the shoe, to keep the ankle at 90°, and a pad, to protect the Achilles tendon and to permit the physiological plantarflexion.

U.S. Pat. No. 5,545,129 (K Snook) teaches of a foot cushioning device especially adapted for use by diabetic persons suffering from a protruding joint disorder of the foot in the arch or instep region includes a thick foam pad having a notch extending into the pad from one side thereof. The pad may be positioned against the sole of a person's foot with a Charcot protrusion accommodated within the notch. An elastic band of non-chafing material may be secured at a first end to the lower surface of the pad by means of hooked anchoring fabric secured to the pad.

GB2454089 (Lyndsay) describes an offloading device that provides an offloading boot wherein a sole element thereof comprises two parts which two members are moveable relative to one another, wherein movement therebetween causes a blood flow stimulating to abut gently against a plantar plexus of the under-sole of a wearer of the boot. During ambulation, the plantar plexus is compressed whereby to assist in venous and arterial drainage of the foot. Whilst this is satisfactory, when a person is walking, upon resting there is no benefit, other than that attributable to offloading. Indeed, for a person with a venous drainage condition, who is an office worker, for example, then during the passage of a day very little benefit will have been derived by the wearing of such a boot, due to the significant periods of time when the worker would have been behind a desk.

Whilst foot pressures, shock, and shear can be reduced with appropriately fitted shoes, insoles, and socks, total non-weight bearing using a wheelchair or crutches is the most effective method of relieving pressure although most patients have difficulty complying with these modalities.

SUMMARY

Despite the known advantages of compressive forces applied to the legs and feet, there has been a need for simple, truly mobile device without the need for further boot arrangements, which enable ambulatory movement.

The present invention seeks to address some of the problems encountered by prior art limb compression devices and methods and by prior art footwear for those who have circulatory problems. In particular the present invention seeks to provide a boot which can stimulate blood flow. A further object to the invention is to provide a boot with a sole which is adaptable to conform to various shapes and conditions of human feet. The present invention seeks to provide a new type of footwear that has a therapeutic benefit for diabetic patients with circulatory problems in their foot and Charcot foot patients for whom circulatory problems arise as a result of immobilisation and or also enables the technique of "off loading" the foot to assist in the healing of any wounds present.

The present invention further seeks to provide a device which is operable to provide constant venous drainage assistance, irrespective of the nature of the actions of the wearer of the device. The present invention further seeks to provide a boot that can improve arterial blood flow in a leg in order to treat ischemic pain and ulceration, and obviate the need for amputation, thereby eliminating the risks of surgery.

In accordance with a first aspect of the invention, there is provided a shoe comprising an upper, a blood flow stimulating element, and a sole element, the upper being operable to enable offloading of the foot, the sole retaining a fluid pump, a fluid reservoir operable to receive fluid at an elevated pressure from the pump via a first valve and a second valve operable to activate the blood flow stimulating element under control of a control processor, the control processor being operable to receive two or more input signals from two or more sensors, wherein the blood flow stimulating element operates in dependence of one or more signals from said sensors. Accordingly, the boot is stiff and ground forces are transmitted through the boot to the shin and calf, whereby to reduce impact upon the foot and reduce supports the leg, when used as an ambulatory device. The blood flow stimulating element abuts the plantar plexus and fluid from a fluid reservoir is caused to activate the blood flow stimulating element. Preferably, the timing of the pulse is selected whereby to provide the least resistance to a venous return flow back up the leg.

In accordance with a second aspect of the invention, the shoe comprises a plaster cast or similar style of shoe/boot created by the provision of plaster or plastics materials upon a user to provide a boot which provides off-loading for when the user is standing, the shoe/boot being provided with a sole element, the sole element retaining a blood flow stimulating element, and fluid pump means operable to activate the blood flow stimulating element wherein the blood flow stimulating element operates subsequent to placement of the foot, in use. The boot is effectively created about the foot of a person desiring the cast; the plaster being applied to the foot once the sole element has been positioned against a sole of a foot of a user, the plaster being arranged as an upper so as to provide offloading, once set. Accordingly, in accordance with a further aspect of the invention, there is provided a sole element for incorporation in a shoe or boot defined by plaster or plaster-like materials.

The blood flow stimulating element abuts the plantar plexus. Fluid from a fluid reservoir is caused to activate the blood flow stimulating element. The fluid is preferably pressurised by an electric pump, conveniently a micro-electric pump, and the pump can be activated when a manual pump has ceased to operate. The blood flow stimulating element can be arranged to operate in dependence upon a period of time since the last operation of the blood flow stimulating element. Conveniently, this time period is variable.

Rather than having the blood flow from a reservoir directly to the bladder, upon placement of the foot upon a ground surface, it has been found that it is beneficial that there is a delay from the moment the sole of the boot meets with a ground surface until the blood flow stimulating device is operates. In particular, it has been found beneficial that when a user of the device is walking, the blood flow stimulating means is operated whilst the user of the device has reduced downward pressure acting upon the sole of the boot, when the foot is being raised, as in a walking gait, or the foot is slid/shuffled across the floor as in the case of a more severe diabetic user, when an attempt is made to raise the foot but lifting of the foot does not actually occur, although the pressure upon the sole of the off-loading boot will have been reduced. Accordingly, in one embodiment, the blood flow stimulating element may be activated upon a minimum force acting upon the sole of the shoe being detected and the shoe can be provided with a sensor operable to determine whether or not the shoe has been placed upon a resilient surface and the control processor is operable to control the blood flow stimulating element with regard to signals from such a force sensor. The blood flow stimulating element can be arranged to operate upon determination of a reduced downward pressure upon the sole of the shoe.

The controller, in a preferred embodiment is connected to pressure sensors wherein, upon the pressure within the mechanically driven pump or the pressure within a reservoir being insufficient or below a particular pressure, then the electrical pump will be utilised. Sensors can be provided which inform the control means of pressure within the reservoir, to enable an electric pump to fill the reservoir, whereby the bladder can, at specific times, induce blood flow; the blood flow stimulating element is induced independent of the operation of the pump, so that the bladder that abuts the plantar plexus operates independently of the pump bladder filling action.

The shoe can be provided with an accelerometer and or pressure sensor operable to determine a gait movement associated with ambulatory motion and the control processor is operable to control the blood flow stimulating element with regard to signals from such sensors. The sole can be provided with a distance finder device operable to determine distance of the sole from the ground and the control processor is operable to control the blood flow stimulating element with regard to signals from the distance finder.

When the controller receives signals from two or more sensors, the blood flow stimulating element can be provided to operate following receipt of all such signals. The timing can be weighted in dependence of the input signals. Conveniently, the timing can be adjusted manually, for example by a clinician following observation of the behaviour, gait or in view of the size and/or weight of the user of the shoe. Ideally, the timing of the pulse is adjusted whereby to provide the least resistance to a venous return flow back up the leg.

Conveniently, the control means comprises a memory operable to store and subsequently download provide clinical feedback information to a clinician, relating to such things as number of steps taken, number of hours worn, number of inflations, time boot taken off and put back on, temperature within the boot, and pressures bearing on the sole of the foot.

The controller, in a preferred embodiment is connected to pressure sensors wherein, upon the pressure within the mechanically driven pump or the pressure within a reservoir being insufficient or below a particular pressure, then the electrical pump will be utilised. Sensors can be provided which inform the control means of pressure within the reservoir, to enable an electric pump to fill the reservoir, whereby the bladder can, at specific times, induce blood flow; the blood flow stimulating element is induced independent of the operation of the pump, so that the bladder that abuts the plantar plexus operates independently of the pump bladder filling action.

Conveniently micro-solenoids control valve operation, whereby the invention does not provide a significant increase in weight to the boot. Indeed, the pump and microcontrollers can be fitted within a sole of a boot of 1 cm height. By enabling sizes of such dimensions, then any fears regarding size—and weight—especially frail elderly patients from using the invention can be allayed. With an internal battery pack, Applicants have provided shoes with a weight of less than 500 g. Conveniently a remote battery pack is connected to the boot, whereby the battery pack can be removed from the shoe/boot.

It will be appreciated that software to control the system can easily and reliably be provided and can advantageously co-operate with a memory to provide useful clinical feedback information to a clinician, relating to such things as number of steps taken, number of hours worn, number of inflations, time boot taken off and put back on, temperature within the boot, and pressures bearing on the sole of the foot.

The present invention thus addresses some of the problems encountered by prior art limb compression devices and methods. In particular the present invention seeks to provide a shoe or a boot which can stimulate blood flow, in ambulatory motion by a wearer of the shoes and in a non-ambulatory fashion, when a person is resting. The significance of this should not be underestimated, with increasing numbers of people with circulatory disorders and who must remain at work; the present invention can provide a realistic solution to this matter.

BRIEF DESCRIPTION OF THE DRAWINGS

For a better understanding of the present invention, reference will now be made, by way of example only, to the Figures as shown in the accompanying drawing sheets, wherein.

DETAILED DESCRIPTION OF THE INVENTION

In order to provide a better understanding of the present invention an embodiment of the invention will now be described. It will be apparent, however, to one skilled in the art, that the present invention may be practised without these specific details. This should not be construed to limit the present invention, but should be viewed merely as an example of a specific way in which the invention can be implemented. Well known features have not been described in detail so as not to obscure the present invention.

Figure 1:
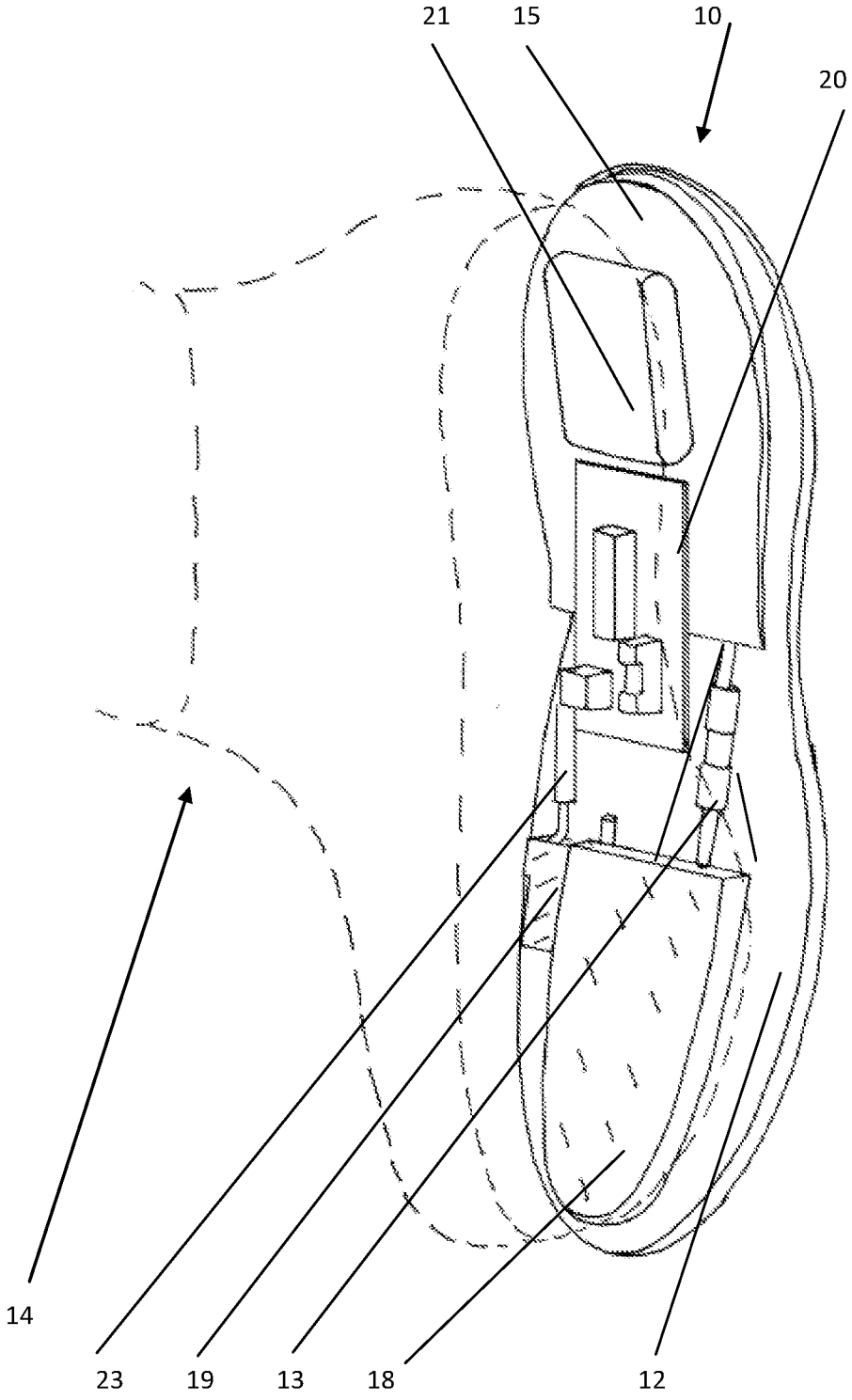
FIG. 1 is a schematic perspective view of a first embodiment of the present invention.
Figure 1A:
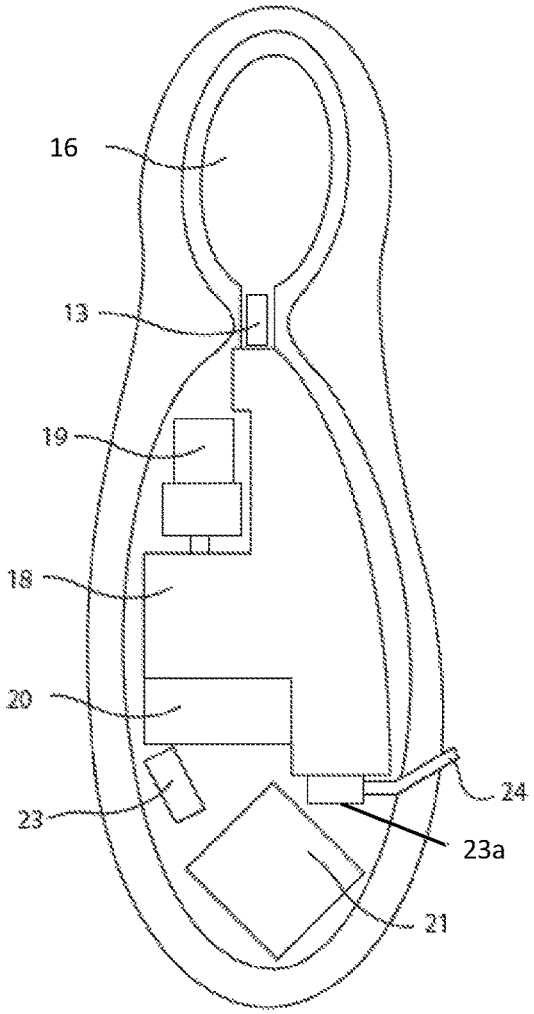
FIGS. 1*a* & 1*b* show a second embodiment in plan and side views

Referring now to FIG. 1, there is shown a first embodiment of the present invention, where there is shown a boot 10 having a sole 12, and an upper 14. Details of the offloading elements are not shown, such elements being known in the art. Heel section 15 includes a fluid pump section 16, which is connected via conduit 13 to a reservoir 18. The fluid is conveniently air; manual pumps and electrical pumps are widely available. An electric pump 19 operates under the control of control means 20 and is powered by a battery of electrical cells 21, which is also connected by a conduit 23 to reservoir 18. When ambulatory, a wearer of the shoe is operable to compress the heel section whereby to force air into the reservoir 18. When a satisfactory pressure of 2-10 psi is not maintained, as determined by a pressure sensor, through inactivity then the controller operates to maintain the pressure within the reservoir by means of pump 19. Conveniently one-way valves from a pump to the reservoir are provided. The pump 19 is conveniently powered by a motor being, for example, a 3.7 v micro-motor compatible for use with lithium ion electrical cells. The heel pump 16 and micro-motor pump 19. will be provided with a filter (not shown) so that dirt is not introduced with intake air whereby it enters into the shoe's internal chambers and passageways. Accordingly, in use there will be build up of pressure within the reservoir.

Figure 1B:
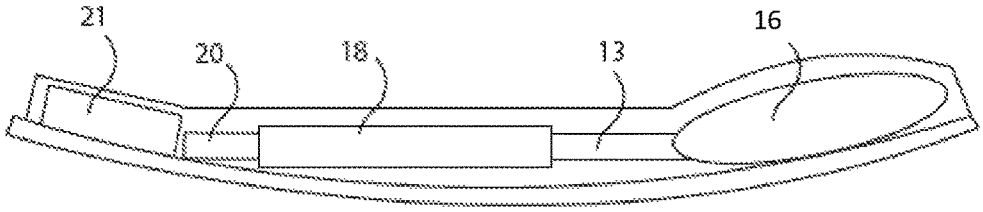

The conduits are conveniently relatively stiff silicone plastics tubing of between 0.5 and 1.0 mm in diameter. Tubing of a greater diameter has been found to damp the action of the bellows operating the blood flow stimulating element and care is needed in selection of tubing, especially for smaller shoes. Figure is shows an alternative sole in plan view showing a solenoid 23*a* which provides fluid to the blood flow stimulating device (not shown) via tube 24. FIG. 1*b* shows the same in side view; the bellows of the heel pump 16 can be seen extending downwardly; in use the heel pump will act to increase pressure within the reservoir, which can also be fitted with a pressure relief valve With reference to FIG. 2, there is shown a schematic layout of the components relating to the plantar plexus stimulating section 25. Between the reservoir and the blood flow stimulating device, there is a valve 23*b* present under the control of the control means 20. The valve is opened for a sufficiently long period to enable the part abutting the plantar plexus to urge movement of sub-dermal veins in the plantar plexus region to at least partially close, urging return of the blood toward the abdomen. It has been found that a period of compression of around half a second is sufficient to improve venous drainage, especially if repeated on a regular basis. Solenoid valves as produced by the Lee Company of Essex, Conn. have been found to be suitable, in particular model number LHDA0531115H. In the use of the controller, pump and solenoid valves, it is preferred that an electrical battery of electrical cells are provide by a remotely, for example retained within a case that can be placed within a pocket. It has been found that NIMH electrical cells arranged to provide a maximum voltage of 4.8V and having a capacity of 2600 mAH provides sufficient energy for a ten hour cycle of operation.

Figure 3:
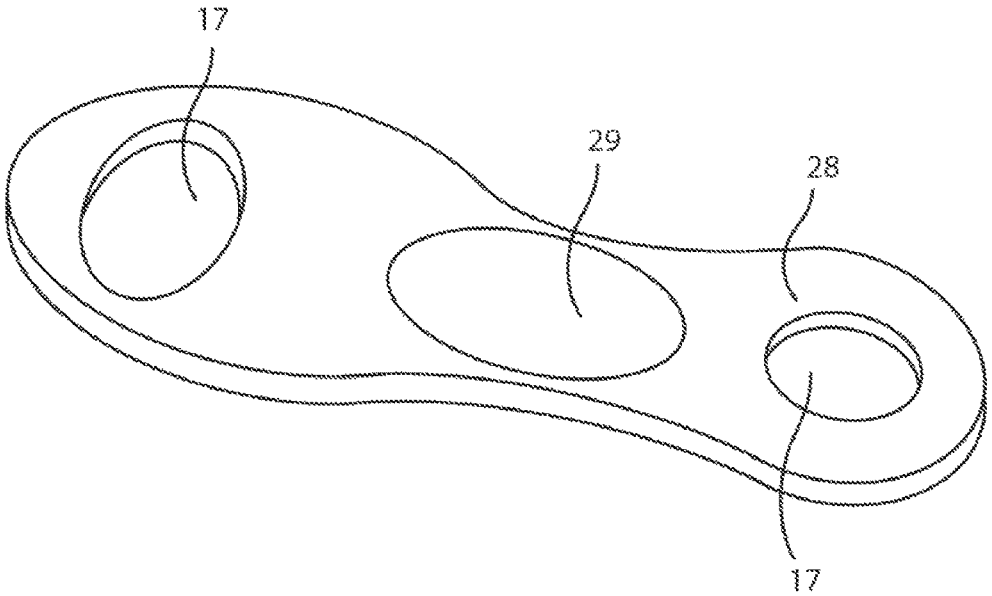
FIG. 3 is a perspective view of an inner sole arrangement.

It will be readily understood that provided the reservoir is maintained at an optimum pressure of 6 psi, then the air can operate bellows of a blood flow stimulating device of 20-60 ml with a pressure of about 3 psi or similar pneumatic arrangement whereby to abut the plantar plexus of a foot of a wearer of the shoe. The reservoir is approximately 50-100 ml in volume and the heel bladder 40-60 ml in volume Turning now to FIG. 3, an inner sole of a shoe is shown; in this particular embodiment, the inner sole is arranged for the support of a foot which is subject to an ulcer or similar lesion on the underside of the foot: the inner sole 28 of the boot is arranged to reduce load on the sole portion subject to ulcer or lesion. The areas of the foot most prone to the ulcers are the heel and main pad of the foot. Conveniently, this is enabled by shaping the inner sole, by means of a sharp knife or small saw, whereby to produce apertures 17 within the inner sole. Additionally, the uppermost portion of the upper provides support to the leg whereby to reduce loading upon the sole of the foot. Additional straps, not shown in FIG. 1, are fastened, tightly about the calf, whereby to support the calf for effective off loading. For hot climates, it will be appreciated that a more sandal like structure can be adopted, although there will always be a requirement for a reasonably substantial calf, to enable off-loading, which is a medical technique employed to help reduce weight or off-load weight acting upon an area of pressure to help give tissue time to heal without repetitive stress which leads to delayed wound healing. As will be appreciated, a reduction of pressure, or offloading, can be an important aspect of diabetic wound care.

A bladder 29 arranged as a raised portion of the sole acts as a blood flow stimulating means and operates—when in use, with a foot placed inside—to abut, in a pulsing fashion, the plantar plexus, whereby to provide a timed pressure to the plantar plexus of the foot, whereby to stimulate and encourage blood flow to and blood flow from the foot. The bladder is conveniently an air bladder: Located under the plantar plexus, to provide the necessary compression, for the pumping effect of the blood to occur. The bladder may comprise an integral part of the innersole; however, by having the bladder and inner sole separate. Other fluids can, of course be used, but this may provide complications; the compressibility of air or other types of gases is used to advantage in a preferred embodiment, but it is to be realised that various hydraulic arrangements can be realised, which may take other advantages of fluids into account whereby to provide a different pressure pulse, dependent upon the severity of the condition; a rapidly deployed pulse is known to be particularly effective for those suffering from deep vein thrombosis.

The bladder situated under the plantar plexus may be linked to further bladders, for example they can be arranged about the foot, to assist in as complete venous drainage as possible.

In a preferred embodiment, the sole element comprises a first mechanically driven pump, a second, electrically driven pump, a pump storage reservoir and a control means, the first and second pump means being selectively operable under the control of the control means, the control means being operable such that upon a condition regarding the mechanical means being satisfied, then the electrically driven pump will operate, whereby the blood flow stimulating element is effective, irrespective of the activity of the person. Conveniently, when the person using the device has become immobile, then the electric pump is switched on. A condition for initiating the electric pump may be one of reduced pressure within the storage reservoir, or one of a time period from last operation of the mechanical pump.

Sensors may be provided to enable valves to fill the bladder at specific times whereby to induce blood flow, the blood flow may be induced independent of the operation of the pump, so that the bladder that abuts the plantar plexus operates independently of the pump bladder filling action. For example, the bladder is filled subsequent to a particular movement of an offloaded leg, for example whilst the foot and boot are moved laterally, when the weight acting through the foot and leg (calf) is reduced, rather than when the weight acting through the leg. Conveniently, the bladder that operates such that it abuts the plantar plexus region comprises part of an arrangement that surrounds the foot. Preferably, the bladder is used in conjunction with a structure around the foot such that as the bladder inflates so the structure will tighten around the foot. Conveniently the foot wrap bladder comprises an elongate loop member which connects with the plantar plexus bladder. It has been found that delay of the operation of the blood flow stimulating element with respect to the action of the pump can improve venous drainage considerably. Conveniently, bladder inflation with respect to a reservoir is controlled by valve means disposed between the reservoir and the bladder, the path between the pump and the bladder having a one-way valve.

In an ambulatory mode the invention utilises various pressure sensors to detect pressures within the various passageways within the boot sole. When the leg is raised, at least in part, the air is released from the reservoir and allowed to flow into the underfoot bladder. This timing of the pulse is selected whereby to provide the least resistance to a venous return flow back up the leg, because when the leg is not supporting the body, the boot will grip surface veins of the foot and lower leg to a reduced degree, assisting in venous flow. Conveniently, a sensor detects a reduction of pressure of the boot upon the ground to activate the valve from the reservoir to the bladder whereby to fill the bladder abutting the plantar plexus, whereby to achieve an increased efficiency in the operation of the boot. The shoe or boot may also have an orientation sensor, whereby to enable the controller to know of the boot being in a horizontal orientation whereby the operation of the blood flow assistance device can be reduced to increase battery life.

The invention can be provided as a boot with an offloading function, operable for effective, ambulatory use or as a cast boot—i.e. an inner sole in accordance with the invention is provided with a bladder and pump and is positioned adjacent the sole of the foot of the person to whom the cast will be fitted and a lining followed by plaster or plastics tape suitably treated with water/activated resin whereby to enable a cast to be realised. Plaster is available almost universally; Techform casting tape is a fibreglass tapes manufactured by Ossur; Alto Cast is another brand, both of which are suitable to enable a plastics cast to be realised.

Conveniently the fluid is air, which is easily compressible and does not to be replaced, as is widely appreciated. In accordance with the present invention, the pressurised fluid from the reservoir is released upon the satisfaction of one or more conditions. For example, the valve could be released after a delay of, say 20 seconds from the maximum sole pressure encountered by a pressure detecting sensor. The delay may be determined by the time of minimum sole pressure encountered by the sole of the boot with respect to a ground surface. The delay may be arbitrarily determined, for example, between, 10 seconds and a minute.

Figure 4A:
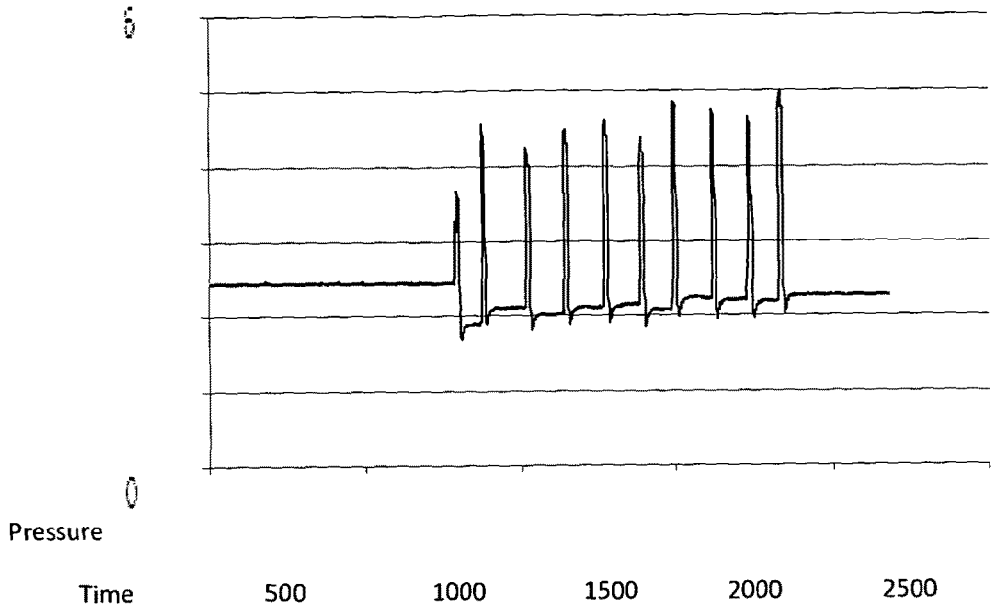
FIGS. 4*a* & 4*b* show output graphs relating to use of the invention; and, FIG. 5 shows where ulcers can occur upon a foot; and, FIG. 6 shows a rocker sole.
Figure 4B:
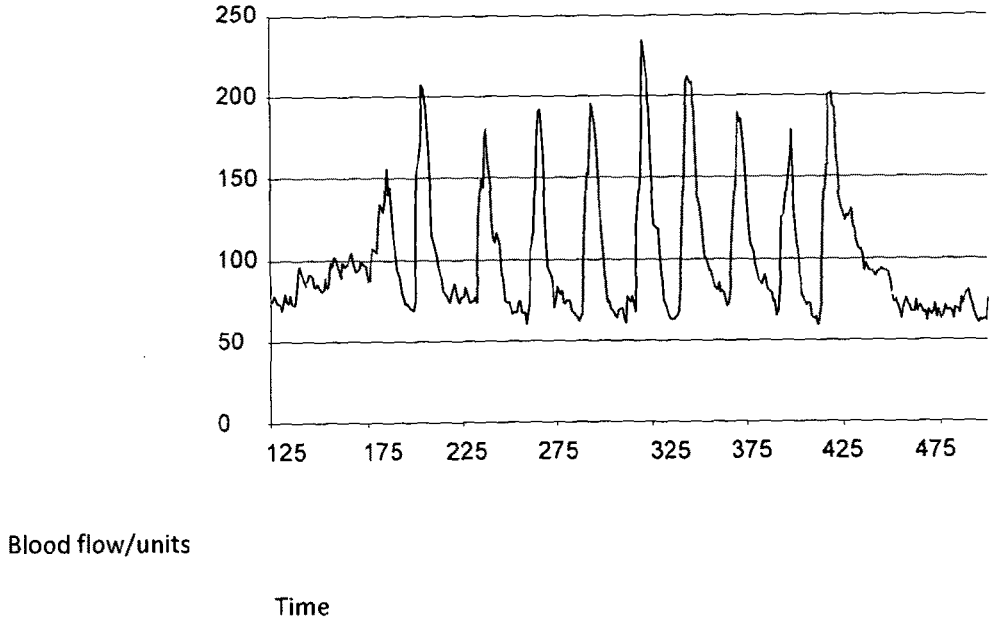

FIG. 4*a* shows a graph showing pressure changes between 2 and 6 psi in the reservoir. Note that the reservoir does not reduce in pressure to 0 psi, although the bladder that is inflated by the reservoir does. This graph comprises a series of ten pulses that were produced by the mechanism. FIG. 4*b* shows a corresponding graph showing changes in blood flow as bladder pressure beneath foot increases and drives blood from the foot. The blood flow is seen to increase from a resting rate of approx 75 units to approximately 200 units with every pulse of the mechanism.

Figure 2:
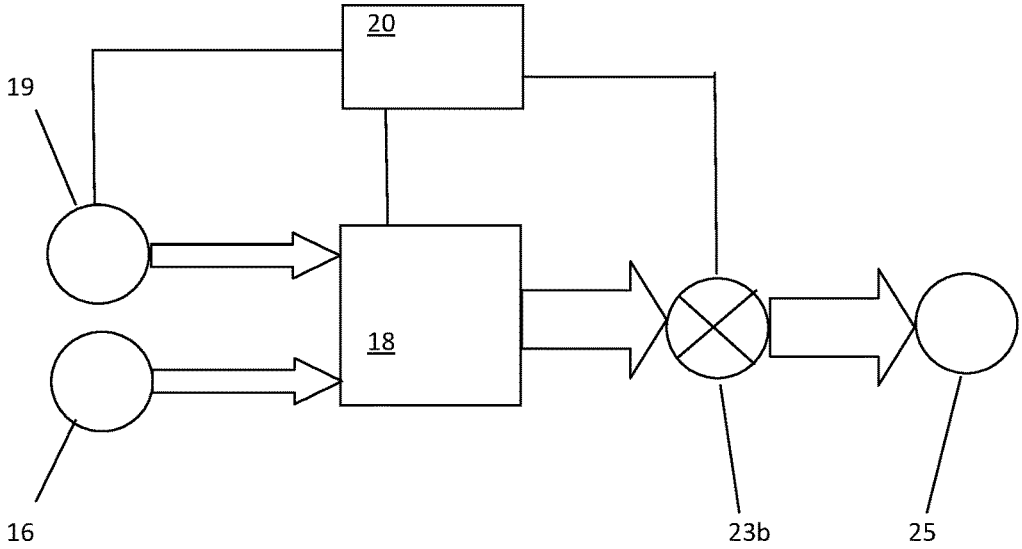
FIG. 2 is a schematic view of the sole components of the invention.

The system employed to derive these results is similar to the device shown in FIG. 2 and consisted of a pump, reservoir, two solenoids, a bladder which inflated beneath the plantar plexus and two check valves to prevent pressure loss. The pump displacement volume was approximately 30 ml. The volume of the reservoir was approx 100 ml. And the volume of the bladder was approximately 60 ml. The port size of the solenoids was 0.5 mm in diameter. The control circuit contained a micro controller and solenoids powered by four rechargeable electrical storage cells (total 4.8 V). The data was recorded using am RS232 link with a laptop PC.

Other forms of devices operable to convert movement arising from ambulatory motion into stored energy can be employed; for example linear motion could be transferred to rotational motion, using a ratchet spring or other form of device to store the energy, conveniently using simple pressure cells and devices or dynamos could be employed; mechanical electricity generation devices could be employed.

Figure 5:
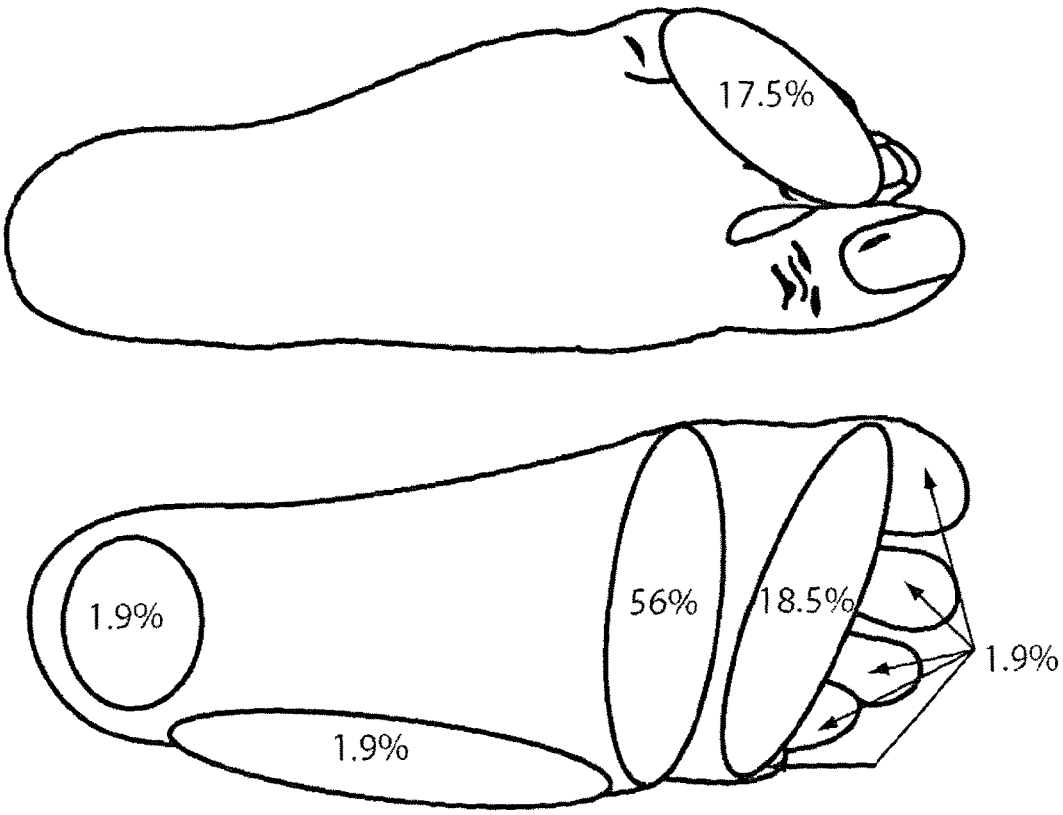

With reference to FIG. 5, there is shown, in outline, views of the foot from above and from below, with a percentage of prevalence of ulcers that were present in a sample of patients having foot ulcers conducted by Lavery et al (2208). Further studies in this area are known from Dr. David G. Armstrong, D.P.M., Dept. Orthopaedics at the University of Texas Health Science Center, see for example, Improvement in healing with aggressive oedema reduction after debridement of foot infection in persons with diabetes, Archives of Surgery, December 2000 Vol 135, p 1405. Ulcers can also arise in the interdigital areas, as indicated in the lower right portion of the Figure. In the case of those suffering from oedema, it may be necessary to provide the boot with a two (or more) part construction; a sole portion is detachable form the upper; whereby placement of the boot can be enabled, without severe discomfort, by the placement of the upper around the foot and calf prior to connection with the sole. Simple quick release connectors can be used for this purpose; where calf or leg bladders are employed, fluid-tight connections means must be used in the event that the calf and sole are completely separable.

It should also be mentioned that the construction of the boot should be such that the foot can perspire; with poor circulation feet will not perspire normally; it has been found that additional vents are beneficial to remove moisture, generally. It will also be appreciated that an additional forced air supply form the pressurising device (either directly of indirectly will assist; an overly moist skin will break down quicker than normal dry skin, which will be an important factor with those who are susceptible to ulcers.

Figure 6:
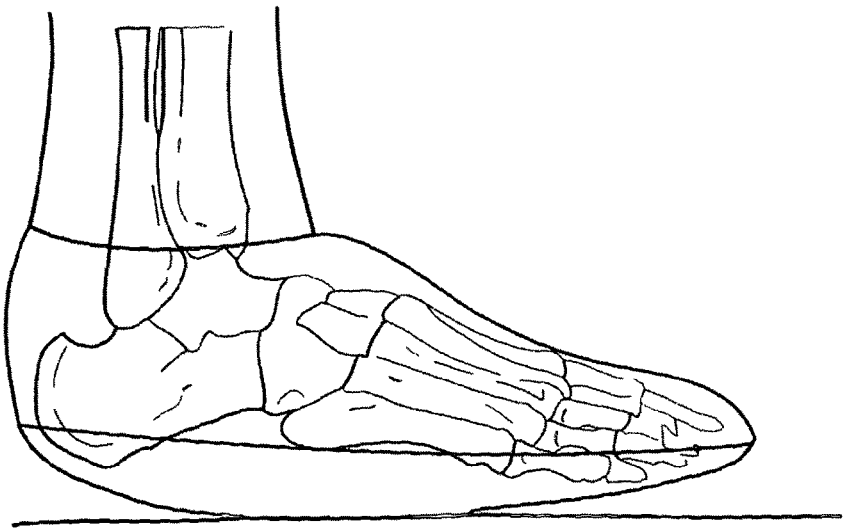

FIG. 6 shows a rocker-sole shoe with the outline of the bones associated with a foot—also referred to as a rocker bottom shoe has a thicker-than-normal sole with rounded heel. Such shoes ensure the wearer does not have flat footing along the proximal-distal axis of the foot. This type of rocker sole has the thickest point farther back on the shoe. This type of rocker shoe can be effective for limiting ankle and mid-foot motion. Thus, it is helpful when a patient has ankle arthritis or mid-foot arthritis. It also can reduce force on the heel at heel strike, as the foot rolls faster off of the heel.

Rocker soles may replace regular soles on any style of footwear. Rocker bottom shoes are also used to compensate for the lost range of motion, however caused, at the ankle joint. In such cases, the wearer maintains solid and stable footing while standing, but the rock of the heel assists with the propulsive phase of gait, making walking more natural and less painful to the affected joints. The construction of most varieties of rocker sole shoes mean that the wearer's body weight is shifted behind the ankle and the wearer is required to do more work than would be required in flat-soled shoe to find their centre of gravity and remain balanced.

The invention claimed is:

1. A shoe comprising an upper, a sole element, and a single blood flow stimulating element;

wherein the upper comprises an offloading support whereby to enable offloading of a foot of a wearer, to transfer a weight-bearing functionality to a calf of the wearer;

wherein the sole element retains a fluid pump, a fluid reservoir operable to receive fluid at an elevated pressure from the pump via a first valve and a second valve operable to activate the single blood flow stimulating element under control of a control processor, the control processor being operable to receive two or more input signals from two or more sensors, wherein the single blood flow stimulating element operates in dependence of one or more signals from said sensors and wherein the single blood flow stimulating element comprises a moveable portion of the sole element and wherein the moveable portion operates to abut gently against a plantar plexus of an under-sole of the wearer of the shoe, whereby to assist in venous and arterial drainage of the foot.

2. The shoe of claim 1, wherein the single blood flow stimulating element operates in dependence upon a period of time since the last operation of the single blood flow stimulating element.

3. The shoe of 1, wherein the single blood flow stimulating element operates in dependence upon a period of time since the last operation of the single blood flow stimulating element, wherein the period of time from receipt of a signal from a sensor until the single blood flow stimulating element operates is variable.

4. The shoe of claim 1, wherein the shoe comprises a sensor operable to determine when the shoe has been placed upon a resilient surface and the control processor is operable to control the single blood flow stimulating element with regard to signals from such a force sensor.

5. The shoe of claim 1, wherein the shoe comprises a sensor operable to determine when there is a reduced downward pressure upon the sole of the shoe and the control processor is operable to control the single blood flow stimulating element with regard to signals from such a force sensor.

6. The shoe of claim 1, wherein the shoe comprises an accelerometer operable to determine a gait movement associated with ambulatory motion and the control processor is operable to control the single blood flow stimulating element with regard to signals from the accelerometer.

7. The shoe of claim 1, wherein the sole element comprises a distance finder device operable to determine distance of the sole from the ground and the control processor is operable to control the single blood flow stimulating element with regard to signals from the distance finder.

8. The shoe of claim 1, wherein an inner sole of the shoe comprises a pressure sensor and is operable to determine a gait movement associated with ambulatory motion, and the control processor is operable to control the single blood flow stimulating element with regard to signals from said pressure sensor.

9. The shoe of claim 1, wherein the single blood flow stimulating element is caused to operate following receipt of two or more signals from sensors.

10. The shoe of claim 1, wherein the single blood flow stimulating element is caused to operate following receipt of two or more signals from sensors, and wherein the single blood flow stimulating element is caused to operate following a delay, a timing being weighted in dependence of the input signals.

11. The shoe of claim 1, wherein the shoe is equipped with only a non-electric mechanical pump.

12. The shoe of claim 1, wherein, a timing of operation of the single blood flow stimulating element is selected whereby to provide the least resistance to a venous return flow back up the wearer's leg.

13. The shoe of claim 1, wherein the control processor comprises a memory operable to store and subsequently download provide clinical feedback information to a clinician selected from a group consisting of a number of steps taken, a number of hours worn, a number of inflations, a time of a boot taken off, a time of a boot put back on, a temperature within the boot, and a pressures bearing on a sole of a foot.

14. The shoe of claim 1, further comprising a mechanism that recovers energy from an amount of kinetic energy that is generated as the wearer applies load to the shoe.

15. The shoe of claim 14, wherein the single blood flow stimulating element operates in dependence upon a period of time since the last operation of the single blood flow stimulating element.

16. The shoe of claim 1, wherein the single blood flow stimulating element operates in dependence upon a period of time since the last operation of the single blood flow stimulating element and wherein an electronic mechanism that can measure blood flow in the foot or a leg of the wearer of the shoe through the use of a transducer is operable to determine a point in time in a walking gait of the wearer the mechanism produces a greatest amount of blood flow.

17. The shoe of claim 1, wherein the sensors comprise electronic sensors selected from the group consisting of pressure sensors, load sensors, accelerometers and distance measuring sensors, to detect when the wearer of the shoe is rested and, as a result, switch powering of the single blood stimulating mechanism to a stored energy system instead of utilizing energy gathered from load bearing of the wearer.

18. The shoe of claim 1, wherein the shoe comprises one of a shoe, boot or plaster cast, wherein the single blood flow stimulating element is, in use, operable to induce blood flow in an otherwise immobile foot retained by the shoe, boot or plaster cast.

* * * * *